US010746036B2

(12) United States Patent
Hiernaux

(10) Patent No.: US 10,746,036 B2
(45) Date of Patent: Aug. 18, 2020

(54) SEALING SYSTEM FOR TURBOMACHINE COMPRESSOR

(71) Applicant: SAFRAN AERO BOOSTERS SA, Herstal (BE)

(72) Inventor: Stéphane Hiernaux, Oupeye (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 162 days.

(21) Appl. No.: 15/994,101

(22) Filed: May 31, 2018

(65) Prior Publication Data

US 2018/0347579 A1 Dec. 6, 2018

(30) Foreign Application Priority Data

Jun. 2, 2017 (BE) ..... 2017/5396

(51) Int. Cl.

| | |
|---|---|
| ***F01D 11/12*** | (2006.01) |
| ***F01D 11/00*** | (2006.01) |
| ***F04D 19/02*** | (2006.01) |
| ***F04D 29/02*** | (2006.01) |
| ***F04D 29/16*** | (2006.01) |

(52) U.S. Cl.

CPC ..... *F01D 11/001* (2013.01); *F01D 11/122* (2013.01); *F04D 19/022* (2013.01); *F04D 29/023* (2013.01); *F04D 29/164* (2013.01); *F05D 2220/323* (2013.01); *F05D 2230/10* (2013.01); *F05D 2230/312* (2013.01); *F05D 2230/60* (2013.01); *F05D 2240/55* (2013.01); *F05D 2300/40* (2013.01); *F05D 2300/506* (2013.01)

(58) Field of Classification Search

CPC ..... F01D 11/001; F01D 11/122; F01D 11/00; F04D 29/164; F05D 2240/55

See application file for complete search history.

(56) References Cited

U.S. PATENT DOCUMENTS

| | | | | |
|---|---|---|---|---|
| 7,686,568 | B2 * | 3/2010 | Moors | F01D 5/225 415/1 |
| 9,243,511 | B2 * | 1/2016 | Lee | F01D 11/122 |
| 10,113,439 | B2 * | 10/2018 | Cortequisse | F01D 9/042 |

(Continued)

FOREIGN PATENT DOCUMENTS

| | | |
|---|---|---|
| EP | 1712743 A2 | 10/2006 |
| EP | 3023595 A1 | 5/2016 |

(Continued)

OTHER PUBLICATIONS

Search Report dated Feb. 7, 2018 for BE 201705396.

*Primary Examiner* — Eldon T Brockman
(74) *Attorney, Agent, or Firm* — James E. Walton

(57) ABSTRACT

A low-pressure compressor for a turbine engine, such as an aircraft turbojet engine includes a rotor with two rows of rotor blades between which two annular ribs are positioned; and one annular row of stator blades between the rotor blades. An internal shroud is connected to the stator blades. The internal shroud includes abradable material collaborating with the annular ribs, and annular teeth made of an abradable material and which extend radially towards the rotor, so as to provide sealing. The system may be used in a method for manufacturing a bypass turbojet engine compressor.

21 Claims, 5 Drawing Sheets

(56) References Cited

U.S. PATENT DOCUMENTS

| | | | | |
|---|---|---|---|---|
| 2008/0075600 | A1* | 3/2008 | Moors | F01D 5/225<br>416/189 |
| 2014/0205444 | A1 | 7/2014 | Zheng et al. | |
| 2015/0240653 | A1* | 8/2015 | Lee | F01D 11/122<br>415/173.4 |
| 2016/0138413 | A1* | 5/2016 | Cortequisse | F01D 9/042<br>415/173.4 |
| 2018/0023409 | A1* | 1/2018 | Lee | F01D 11/122<br>415/173.4 |

FOREIGN PATENT DOCUMENTS

| | | | |
|---|---|---|---|
| EP | 3073055 | A2 | 9/2016 |
| WO | 2016059348 | A1 | 4/2016 |

* cited by examiner

SEALING SYSTEM FOR TURBOMACHINE COMPRESSOR

This application claims priority under 35 U.S.C. § 119 to Belgium Patent Application No. 2017/5396, filed 2 Jun. 2017, titled "Sealing System for Turbomachine Compressor," which is incorporated herein by reference for all purposes.

BACKGROUND

1. Field of the Application

The present application relates to sealing in a compressor of an axial turbine engine, notably in the region of an internal shroud. The present application also relates to an axial turbine engine, such as an aircraft turbojet engine or an aircraft turboprop engine. The present application also proposes a method for manufacturing a compressor.

2. Description of Related Art

The compression ratio at the outlet of a turbojet engine compressor is dependent on the sealing between the shrouds and the rotor. This sealing needs to be able to adapt to vibrations and also to ingestions when the compressor concerned is a low-pressure compressor. Centrifugal force and expansion are still constraints which have to be added to the preceding ones.

Document EP3023595A1 discloses a turbojet engine equipped with a low-pressure compressor in which internal shrouds limit leakages around the rotor. Each internal shroud or each internal-shroud segment comprises: a circular or semi-circular wall the profile of which extends mainly axially; and a row of openings formed in the axial wall. Each opening has opposing edges intended to be arranged laterally on either side of a stator blade positioned in the said opening with a view to attaching same. Furthermore, the wall comprises a radial flange which passes through the openings in the circumferential direction of the shroud or of the shroud segment, so as to form a mechanical connection within each opening to connect the opposing edges thereof.

Although great strides have been made in the area of sealing compressors, many shortcomings remain.

DETAILED DESCRIPTION OF THE PREFERRED EMBODIMENT

Figure 1:
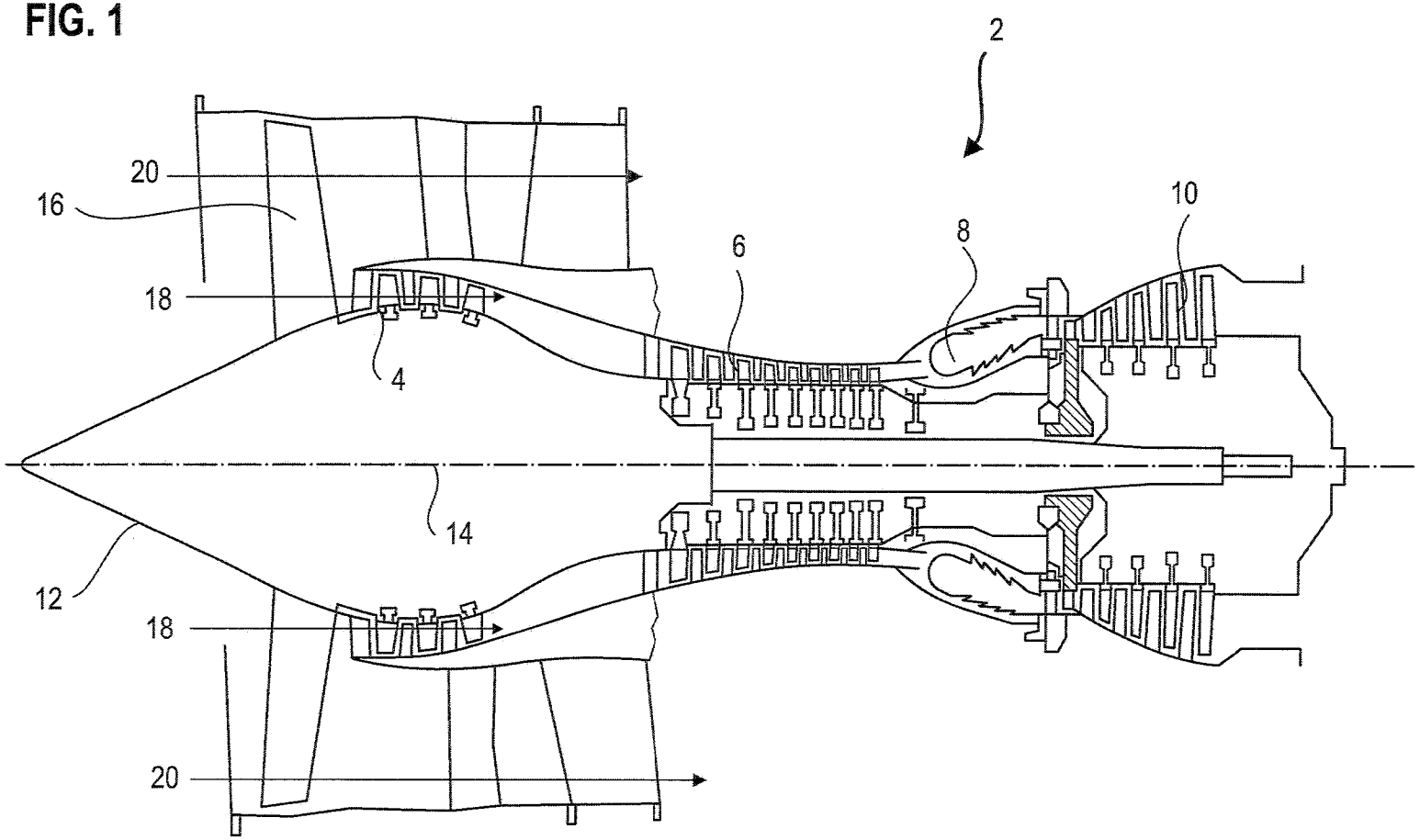
FIG. 1 depicts an axial turbine engine according to the present application.

The present application aims to solve at least one of the problems presented by the prior art. More specifically, it is an objective of the present application to be able to reduce leakages in a compressor. Another objective of the present application is to propose a simple, strong, lightweight, economical, reliable solution that is easy to produce, convenient to maintain, easy to inspect, and that improves efficiency.

One subject of the present application is a compressor of a turbine engine, notably a turbomachine low-pressure compressor, the compressor comprising: a rotor with at least one annular rib; an annular row of stator blades; an internal shroud connected to the stator blades and comprising at least one layer of abradable material able to collaborate with the at least one annular rib of the rotor so as to provide a sealing; notable in that the internal shroud comprises at least one annular tooth made of abradable material and extending radially towards the rotor.

According to advantageous embodiments of the present application, the compressor may comprise one or more of the following features, considered in isolation or in any technically feasible combination:

the annular tooth and the rotor have between them a first radial clearance J1, and the annular rib and the internal shroud have between them a second radial clearance J2 which represents between 50% and 150% of the first radial clearance J1.

The first radial clearance J1 is equal to the second radial clearance J2.

The annular tooth comprises a trapezoidal or triangular profile of revolution. The profile of revolution is considered about the axis of rotation of the rotor.

The annular tooth is axially thicker than the annular rib.

The annular tooth has a radial height equal to the radial height of the annular rib.

The annular tooth and the annular rib overlap radially over the majority of their radial heights.

The material of the annular tooth is different from that collaborating with the annular rib, and potentially more friable.

The abradable material of the annular tooth is the same as that collaborating with the annular rib; the said materials potentially being formed as one and/or forming a one-piece assembly.

The rotor comprises at least two annular rows of rotor blades between which the annular tooth is arranged axially, the at least two annular rows of rotor blades forming a one-piece assembly.

The internal shroud comprises an internal annular surface from which the annular tooth extends radially, the said surface comprising a circular groove arranged axially at the level of the annular rib.

The internal shroud comprises an annular wall, potentially made from a composite material.

The annular wall radially separates the stator blades from the annular tooth.

The annular tooth is a first annular tooth, the internal shroud comprising other, potentially at least two other, annular teeth made from abradable material and extending radially towards the rotor, the annular teeth potentially being distributed axially along the internal shroud.

The annular rib is a first rib, the rotor further comprising at least a second annular rib, the annular ribs and the or each annular tooth alternating with one another.

The radial clearance J2 represents between 80% and 120%, or between 90% and 110%, of the radial clearance J1.

The clearance J1 and/or the clearance J2 represents at most: 20%, or 10%, or 5%; or 3% of the radial height of the tooth or of the rib, respectively.

The compressor is an axial-flow compressor.

The tooth comprises a circular tip oriented radially towards the inside.

The rib comprises a circular tip oriented radially towards the outside.

The tooth has a profile of revolution the radial height of which is greater than the axial thickness, potentially at least: two or three or four or five times greater than the axial thickness. These proportions may apply to the profile of revolution of the annular rib.

In operation, the tooth turns and/or enters into the groove.

The abradable material of the tooth is a first material, that collaborating with the rib is a second material which is potentially of higher density and/or harder than the first material.

The rotor is a one-piece drum with an external surface supporting each annular rib.

The wall and the tooth are made from different materials.

The rotor comprises a radial overthickness radially facing the tooth and/or extending radially towards the tooth.

The tooth and the rib extend over most of the radial space between the rotor casing and the internal surface of the shroud. The said space extends over the entire length of the shroud.

The rib has a hardness higher than the hardness of the tooth, potentially at least: twice as high or five times or ten times higher. The hardnesses may be Vickers hardnesses.

Another subject of the present application is a compressor of a turbine engine, comprising: a rotor with at least one annular rib; an annular row of stator blades; an internal shroud connected to the stator blades which comprises: at least one layer of abradable material able to collaborate with the at least one annular rib of the rotor, one annular tooth made of abradable material and extending radially towards the rotor, the radial clearances measured at the axial level of the annular rib and of the annular tooth being equal.

Another subject of the present application is a turbine engine, notably an aircraft turbojet engine, comprising a compressor, notable in that the compressor is in accordance with the present application, and for preference, the annular tooth contains an organic material such as a polymer. Another subject of the present application is a method for manufacturing a turbine engine compressor, the method comprising the following steps: (a) of supplying or creating an annular row of stator blades; (b) of attaching an internal shroud to the annular row of stator blades, the said internal shroud comprising abradable material; (c) of adding at least one annular tooth made of abradable material inside the internal shroud; (d) of positioning the abradable material of the internal shroud around an annular rib of a rotor of the compressor in accordance with the present application.

According to one advantageous embodiment of the present application, step (c) of adding comprises a phase of moulding or bonding or plasma-spraying abradable material into the internal shroud; at the end of step (d) of positioning, the compressor is potentially in accordance with the present application.

According to one advantageous embodiment of the present application, step (c) of adding comprises a phase of machining the abradable material in order to cut the annular tooth therein.

According to one advantageous embodiment of the present application, at the end of the moulding or bonding phase the abradable material forms the annular tooth.

The thicknesses and/or the heights may be mean values.

The features given in relation to an annular tooth may apply to each annular tooth. The same applies to the ribs.

In general, the advantageous embodiments of each subject of the present application are also applicable to the other subjects of the present application. Each subject of the present application can be combined with the other subjects, and the subjects of the present application can also be combined with the embodiments of the description, which in addition can be combined with one another, in any technically feasible combination, unless explicitly specified to the contrary.

The present application makes it possible to create further rub strips carried by the internal shroud. Their presence affords an effect which combines with that of the rotor, amplifying vortices under the shroud in order to slow the secondary flows. Sealing is improved without adversely affecting the inertia of the rotor.

Moreover, the creation of the teeth made from the abradable material respects the integrity of the rotor. Radially, there are two levels of sealing created which act in series, while at the same time allowing an installation that respects the axial and radial compactness.

In the description which follows, the terms "internal" and "external" refer to positioning with respect to the axis of rotation of an axial turbine engine. The axial direction corresponds to the direction along the axis of rotation of the turbine engine. The radial direction is perpendicular to the axis of rotation. Upstream and downstream are with reference to the main direction of flow of the stream through the turbomachine. What is meant by an abradable material is a material capable of crumbling on contact with the rotor in order to limit the wearing of the latter.

FIG. 1 is a simplified depiction of an axial turbine engine. In this particular instance it is a bypass turbojet engine. The turbojet engine 2 comprises a first compression stage, referred to as the low-pressure compressor 4, a second compression stage referred to as the high-pressure compressor 6, a combustion chamber 8 and one or more turbine stages 10. In operation, the mechanical power of the turbine 10, transmitted via the central shaft to the rotor 12, drives the movement of the two compressors 4 and 6. These compressors comprise several rows of rotor blades associated with rows of stator blades. Rotation of the rotor about its axis of rotation 14 thus makes it possible to generate an air flow and progressively compress the latter until it enters the combustion chamber 8.

An inlet blower commonly referred to as a fan 16 is coupled to the rotor 12 and generates an air stream which splits into a primary stream 18 that passes through the various aforementioned turbomachine stages and a secondary or bypass stream 20 that passes along an annular duct (partially depicted) along the machine to recombine with the primary stream at the outlet from the turbine. The fan may be of the unducted type.

The bypass stream may be accelerated so that it generates a reaction thrust needed for the flight of an aircraft. The primary 18 and bypass 20 streams are coaxial annular flows one inside the other. They are ducted by the casing of the turbine engine and/or by the shrouds.

Figure 2:
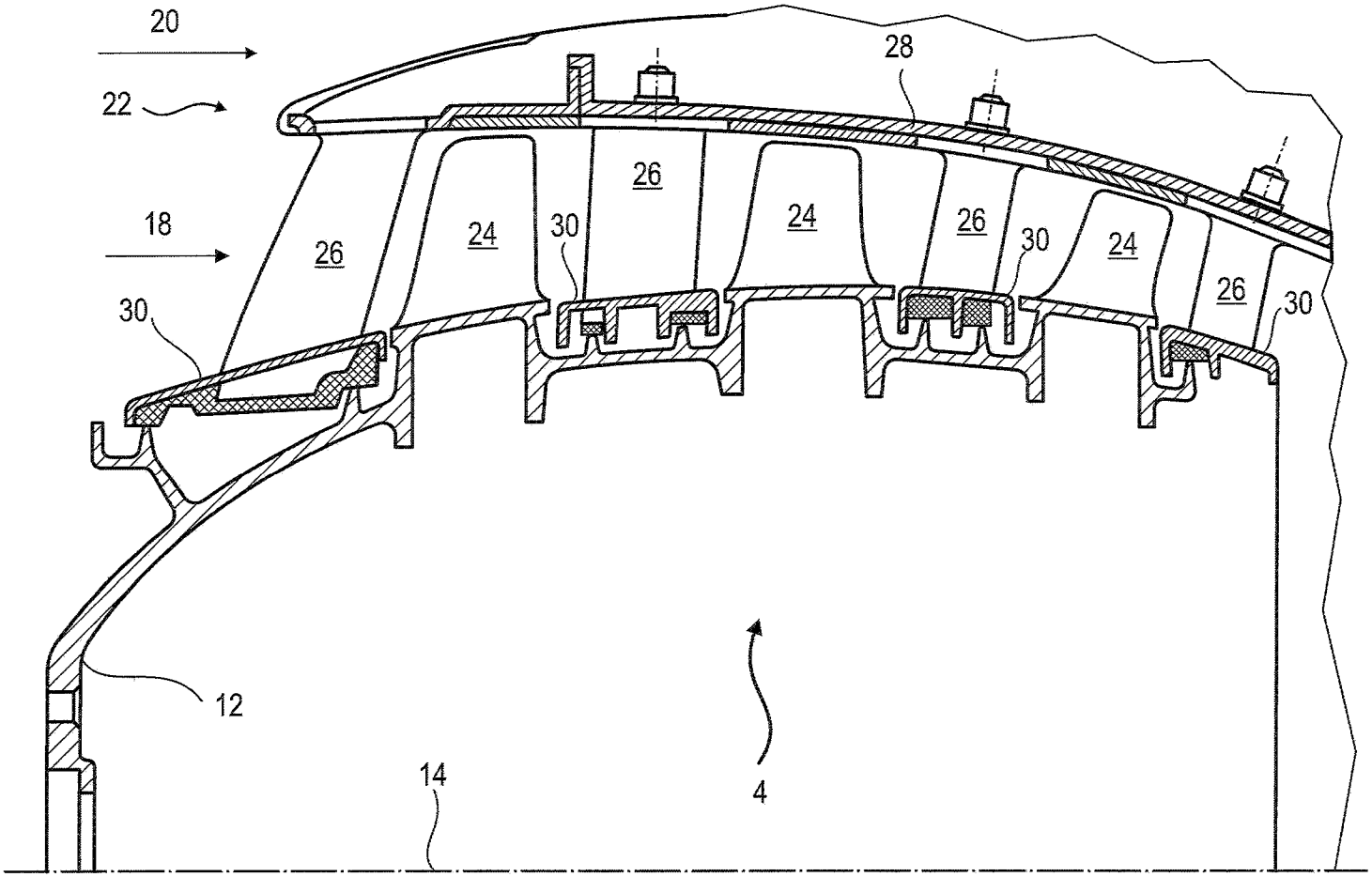
FIG. 2 is a diagram of a turbine engine compressor according to the present application.

FIG. 2 is a view in cross section of a compressor of an axial turbomachine like that of FIG. 1. The compressor may be a low-pressure compressor 4. The splitter 22 that separates the primary stream 18 from the bypass stream 20 can be seen. The rotor 12 comprises several rows of rotor blades 24, in this instance three rows. It may be a one-piece drum. It forms a solid connecting all its rows of blades. Potentially, one, or several, or each, of the rows of rotor blades 24 is rigidly connected to the rotor, and therefore to the drum where appropriate. Alternatively, the rotor blades have dovetail fixings.

The low-pressure compressor 4 comprises several sets of guide vanes, in this instance four, each containing a row of stator blades 26. The guide vanes are associated with the fan or with a row of rotor blades to straighten the air stream, so as to convert the speed of the stream into a pressure, notably a static pressure.

The stator blades 26 extend essentially radially from an external casing 28, and may be fixed thereto and immobilized using pins. The casing 28 may be formed of two half-shells. The rows of stator blades 26 support internal shrouds 30 the external surfaces of which guide the primary stream 18. The internal shrouds 30 may have a profile of revolution about the axis of rotation 14. They provide dynamic sealing with the rotor 12, notably in combination with the annular ribs thereof, commonly referred to as rub strips. These minimize leakages in so far as they allow closer spacing to the rotor, said closer spacing closing up the mechanical clearances during operation. Thus, a shroud and a portion of rotor 12 may form a sealing system.

Figure 3:
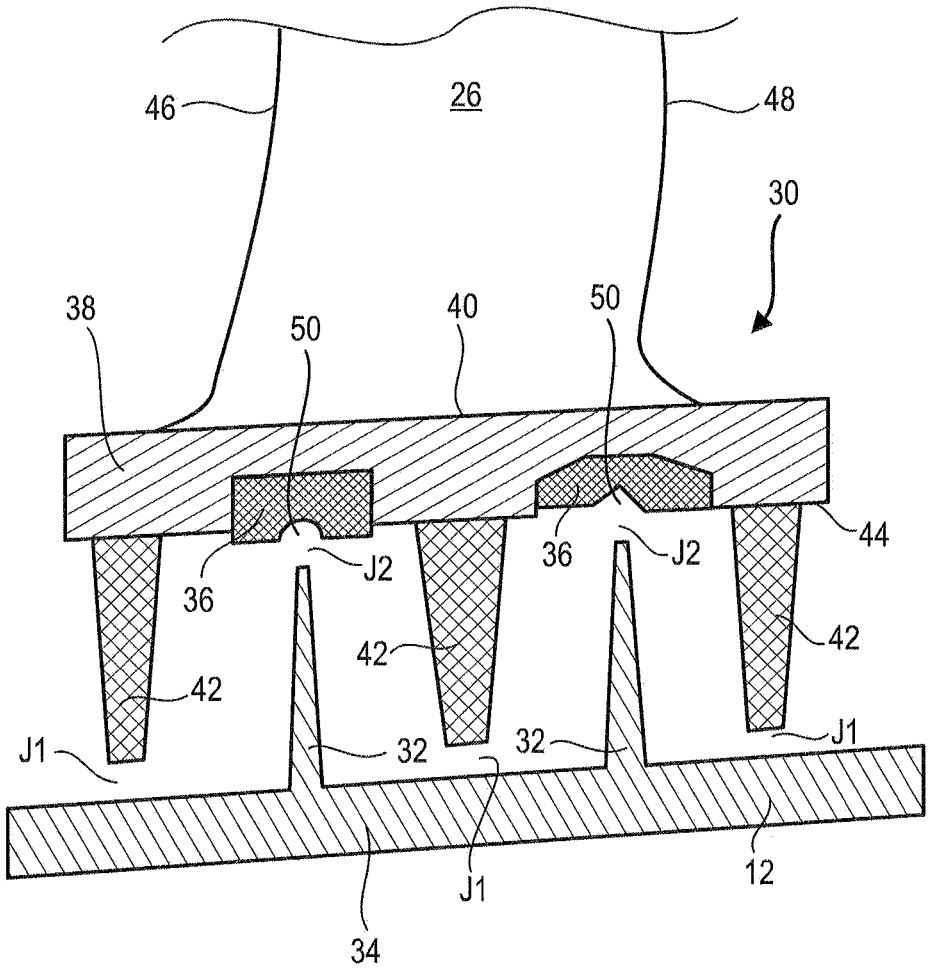
FIG. 3 illustrates a sealing system according to a first embodiment of the present application.

FIG. 3 schematically indicates a sealing system like those of FIG. 2. It shows: a stator blade 26 representative of its row, an axial portion of rotor 12, and an internal shroud 30. The shroud 30 may be segmented. It may be made from a fibre-reinforced organic matrix composite material. The system is depicted here at rest, the rotational speed of the ribs 32 with respect to the teeth 42 being zero.

The rotor 12 comprises at least one, in this instance two, annular ribs 32 which extend radially towards the outside from the casing 34 of the rotor 12. The casing 34 may correspond to that of the drum. These ribs 32 form circular blades with circular tips facing the internal shroud 30, notably radially facing dedicated layers of abradable material 36. These layers 36 may be housed within the radial thickness of the annular wall 38 of the internal shroud 30.

Radially opposite the external surface 40 of the shroud 30, the latter has at least one annular tooth 42, for example two or three annular teeth 42. These teeth 42 extend radially from the internal surface 44 of the shroud 30. The teeth 42 project from this internal surface 44.

The teeth 42 may be distributed axially over the length of the shroud 30, potentially uniformly. The upstream one may be axially at the level of, or upstream of, the leading edge 46 of the blade 26. The downstream one may be axially at the level of, or downstream of, the trailing edge 48 of the blade 26. The teeth 42 and the ribs 32 form an alternation so that they enclose annular chambers between the rotor 12 and the shroud 30; the said chambers experience closing-together of their circular edges during operation, hence improving sealing, increasing the compression ratio and optimizing engine efficiency.

The teeth 42 and the ribs 32 extend radially in opposite directions. They may cross one another radially. They may radially overlap, possibly over the majority of their respective radial heights. Their axial faces, which are potentially planar or substantially conical, axially face one another. The teeth 42 and the ribs 32 may be of equal or similar heights, namely have a difference in height representing at most: 10%, or 5%.

Potentially, the or several of the or each clearance J1 that remains radially between one of the teeth 42 and the rotor 12, more specifically between one of the teeth 42 and the casing 34, may be equal to at least one, or several of, or each clearance J2 between the shroud 38 and one of the ribs 32. Potentially, all the clearances J1 are equal; and/or all the clearances J2 are equal. This arrangement encourages sealing and allows the teeth to play a substantially equivalent role to the ribs. As the teeth come radially closer to the rotor, the ribs reduce their margins to the shroud at the same time. In the event of contact, on the one side as on the other, the mechanical impact is controlled because the teeth are able to crumble away against the rotor without damaging it.

The abradable material of the teeth 42 may differ from that of the layers 36 radially facing the ribs 32. Thus, different properties may be chosen. By way of example, the first abradable material, used in the teeth 42, may be softer than the second which is present in the layers 36. That preserves the rotor 12. These materials may be elastomers, possibly with different concentrations of hollow spheres, or a different filler content. Also, the teeth may be softer than the ribs. The ribs may be made of titanium and/or with a Vickers hardness greater than or equal to: 200 MPa, or 900 MPa. The Vickers hardness of the teeth is less than or equal to: 100 MPa, or 10 MPa.

The ribs 32 may be axially more slender than the teeth 42. That optimizes the use of space under the shroud, optimizes the rotary mass and mechanical strength.

Optionally, the internal shroud 30 may comprise at least one circular groove 50, potentially one for each rib 32. Each circular groove 50 is open radially towards the inside and is able to accept the circular tip of a rib 32. Each groove 50 extends radially in a different direction from the teeth 42, notably from the internal surface 44. This allows better closing-up of the clearances during operation. Each clearance J2 can be measured against the bottom of the corresponding groove 50. Optionally, the grooves 50 are formed in the layers 36.

Figure 4:
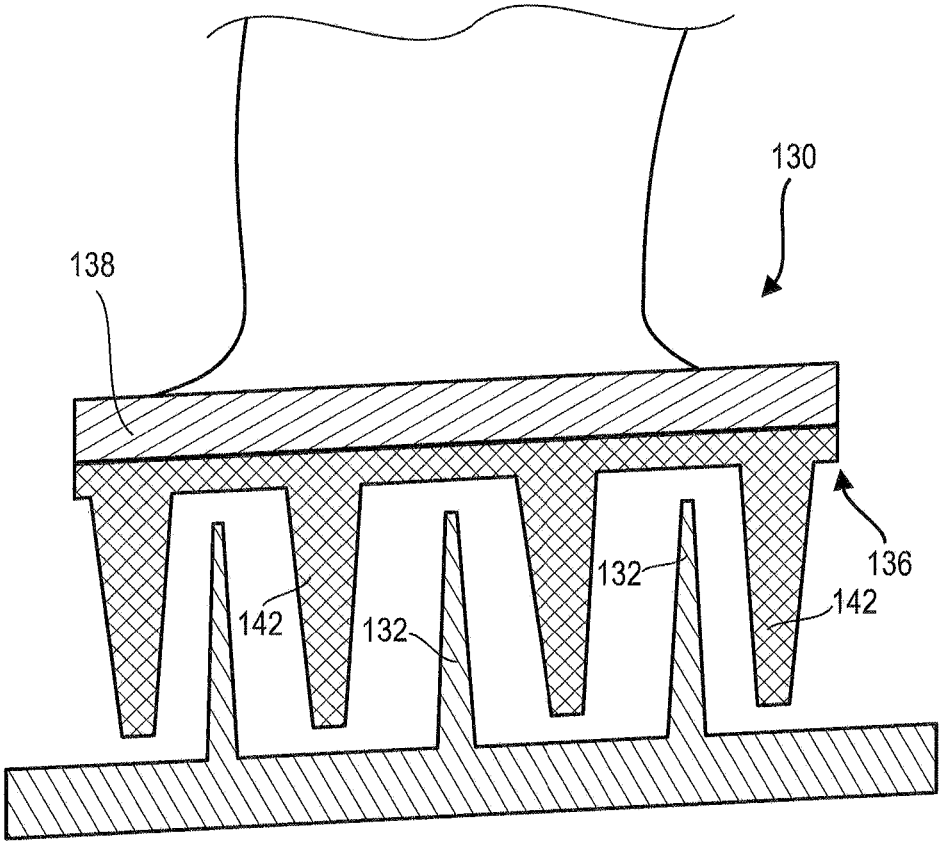
FIG. 4 illustrates a sealing system according to a second embodiment of the present application.

FIG. 4 depicts a sealing system according to a second embodiment of the present application. This FIG. 4 reuses the numbering system of the preceding figures for elements that are identical or similar, the numbering system being, however, incremented by 100. Specific numerals are used for elements that are specific to this embodiment.

The sealing system is substantially identical to that of FIG. 3, although it differs therefrom in that the annular teeth 142 are formed in the one same abradable layer 136 which further collaborates with the ribs 132. This layer is borne by the wall 138 of the internal shroud 130 and forms the internal surface 144. The numbers of teeth 142 and of ribs 132 also change.

Once again, the ribs 132 and the teeth 142 are placed so that they alternate with one another. The ribs 142 face two teeth 132. The radial heights of the teeth are equal to the heights of the ribs.

According to the present application, it is conceivable to create a hybrid compressor, which means to say one which comprises one or more sealing systems according to FIG. 3, and one or more sealing systems according to FIG. 4. Circular grooves (not depicted) may be added, notably in the layer 136.

Figure 5:
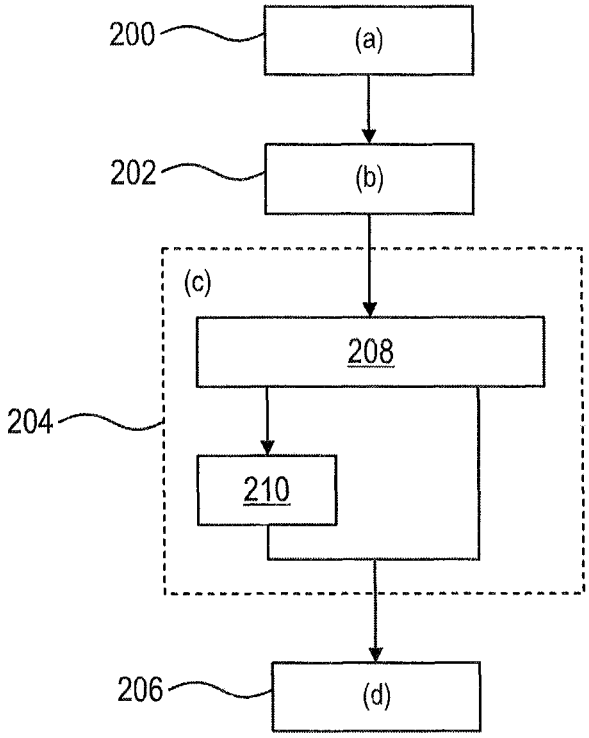
FIG. 5 is a diagram of the method for manufacturing a turbine engine compressor according to the present application.

FIG. 5 schematically depicts a diagram of the method for manufacturing a turbine engine compressor. This method may be an assembly and/or shaping method. The compressor may correspond to the one described in conjunction with FIGS. 1 and 2, the compressor sealing systems being, for example, in accordance with the teachings of FIGS. 3 and/or 4.

The method for manufacturing the compressor may comprise the following steps, potentially carried out in the following order:

(a) supply or creation 200 of an annular row of blades, and mounting of these blades to the external casing of the compressor;

(b) attachment 202 of an internal shroud to the annular row of blades, the said internal shroud comprising some abradable material;

(c) addition 204 of at least one or several annular teeth made of abradable material inside the internal shroud;

(d) positioning 206 of the abradable material of the internal shroud around the annular ribs of the compressor rotor.

Step (c) of addition 204 may be a step of creating or mounting a tooth inside the shroud. Step (c) of addition 204 may comprise a phase 208 of applying abradable material inside the shroud. The application phase 208 may be performed by moulding or bonding or plasma spraying.

Thereafter, step (c) of addition 204 comprises a phase 210 of machining the abradable material in order to cut the annular tooth therein. The machining may be performed by turning, notably by placing the shroud on a chuck. In this case, the application phase 208 tends to use an annular stratum of abradable material as an overthickness in comparison with the teeth. The excess material is cut away to retain only the material specific to the teeth.

As an alternative or in addition, the phase 208 of applying abradable material may make it possible to form one or each tooth directly. Potentially, one tooth exhibits its definitive shape, and another exhibits an excess of material which is removed by cutting and/or machining.

I claim:

1. Compressor of a turbine engine, the compressor comprising:

a rotor with at least one annular rib;

an annular row of stator blades; and an internal shroud connected to the stator blades and comprising:

at least one layer of abradable material able to cooperate with the at least one annular rib of the rotor;

wherein the internal shroud comprises:

at least one annular tooth made of abradable material and extending radially towards the rotor.

2. Compressor according to claim 1, wherein the annular tooth and the rotor have between them a first radial clearance, and the annular rib and the internal shroud have between them a second radial clearance which represents between 50% and 150% of the first radial clearance.

3. Compressor according to claim 2, wherein the first radial clearance is equal to the second radial clearance.

4. Compressor according to claim 1, wherein the Vickers hardness of the annular rib is higher than the Vickers hardness of the annular tooth.

5. Compressor according to claim 1, wherein the annular tooth is axially thicker than the annular rib.

6. Compressor according to claim 1, wherein the annular tooth has a radial height equal to the radial height of the annular rib.

7. Compressor according to claim 1, wherein the annular tooth and the annular rib overlap radially over the majority of their radial heights.

8. Compressor according to claim 1, wherein the material of the annular tooth is more friable than that collaborating with the annular rib.

9. Compressor according to claim 1, wherein the annular tooth and the layer of abradable material being integral and made of the same material.

10. Compressor according to claim 1, wherein the rotor comprises:

at least two annular rows of rotor blades between which the annular tooth is arranged axially, the at least two annular rows of rotor blades forming a one-piece assembly.

11. Compressor according to claim 1, wherein the internal shroud further comprises:

an internal annular surface from which the annular tooth extends radially, the said internal surface comprising:

a circular groove arranged axially at the level of the annular rib.

12. Compressor according to claim 1, wherein the internal shroud further comprises:

an annular wall made from a composite material.

13. Compressor according to claim 12, wherein the annular wall radially separates the stator blades from the annular tooth.

14. Compressor according to claim 1, wherein the annular tooth is a first annular tooth, the internal shroud further comprising:

at least a second annular tooth, both annular teeth being made from abradable material and extending radially towards the rotor, the annular teeth being distributed axially along the internal shroud.

15. Compressor according to claim 1, wherein the annular rib is a first rib, the rotor comprising:

at least a second annular rib, the annular ribs and the or each annular tooth alternating with one another.

16. Compressor according to claim 1, wherein the annular tooth contains an organic material.

17. Compressor of a turbine engine, the compressor comprising:

a rotor with at least one annular rib;

an annular row of stator blades; and an internal shroud connected to the stator blades and comprising:

at least one layer of abradable material able to cooperate with the at least one annular rib of the rotor;

wherein the layer of abradable material comprises:

at least one annular tooth protruding radially inwardly.

18. Method for manufacturing a turbine engine compressor, the method comprising:

(a) supplying or creating an annular row of stator blades;

(b) attaching an internal shroud to the annular row of stator blades, the said internal shroud comprising abradable material;

(c) adding at least one annular tooth made of abradable material inside the internal shroud; and (d) positioning the abradable material of the internal shroud around an annular rib of a rotor of the compressor.

19. Method according to claim 18, wherein step (c) of adding comprises:

a phase of moulding or bonding or plasma-spraying abradable material into the internal shroud.

20. Method according to claim 18, wherein step (c) of adding comprises:

a phase of machining the abradable material in order to cut the annular tooth therein.

21. Method according to claim 19, wherein at an end of the moulding or bonding phase the abradable material forms the annular tooth.

* * * * *